US010709262B2

(12) United States Patent
Fosse et al.

(10) Patent No.: US 10,709,262 B2
(45) Date of Patent: Jul. 14, 2020

(54) CHILD CARRYING SYSTEM

(71) Applicant: Lalabu LLC, Statham, GA (US)

(72) Inventors: Brian Fosse, Bend, OR (US); John Martin, Vashon, WA (US); Mirona Motoc, Seattle, WA (US); Brian Fletcher, Issaquah, WA (US); Zac West, Seattle, WA (US)

(73) Assignee: Lalabu LLC, Statham, GA (US)

( * ) Notice: Subject to any disclaimer, the term of this patent is extended or adjusted under 35 U.S.C. 154(b) by 0 days.

(21) Appl. No.: 16/591,284

(22) Filed: Oct. 2, 2019

(65) Prior Publication Data

US 2020/0107649 A1 Apr. 9, 2020

Related U.S. Application Data

(60) Provisional application No. 62/740,811, filed on Oct. 3, 2018.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A45F 3/04
See application file for complete search history.

(56) References Cited

U.S. PATENT DOCUMENTS 4,149,687 A 4/1979 Nunemacher
4,449,253 A 5/1984 Hettinger
4,467,945 A 8/1984 Schaapveld
4,602,390 A 7/1986 Morera et al.
5,205,450 A * 4/1993 Derosier ..... A47D 13/025 224/161
5,547,461 A * 8/1996 Levis ..... A45F 3/04 128/876
5,732,861 A 3/1998 Jakobson
5,766,114 A 6/1998 Campbell
5,799,851 A 9/1998 Wulf et al.
(Continued)

FOREIGN PATENT DOCUMENTS

CN 101426456 A 5/2009
JP 3787778 B2 6/2006
WO 2017200451 A1 11/2017

OTHER PUBLICATIONS

Final Office Action, dated Jan. 8, 2019, from corresponding U.S. Appl. No. 15/861,546.

(Continued)

*Primary Examiner* — Brian D Nash
(74) *Attorney, Agent, or Firm* — Brient IP Law, LLC

(57) ABSTRACT

A dual-wrap child carrying system is configured to be worn by a person for carrying a child. The system includes a dual-wrap garment and a child support configured to releasably attach to the dual-wrap garment. The dual-wrap garment includes a primary wrap, a number of stays positioned in a back segment of the primary wrap for flexible support, and a secondary wrap. The primary wrap is configured to encircle the person and secure at a front side of the person. The secondary wrap includes a stretchable textile having a higher elasticity than a material of the primary wrap and is configured to encircle the person over the primary wrap and secure at the front side of the person.

20 Claims, 16 Drawing Sheets

(56) References Cited

U.S. PATENT DOCUMENTS

| | | | | |
|---|---|---|---|---|
| 5,813,580 | A | 9/1998 | Fair | |
| 5,848,741 | A * | 12/1998 | Fair | A47C 7/66 224/160 |
| 6,179,187 | B1 * | 1/2001 | Lemire | A45F 3/04 224/153 |
| 6,240,564 | B1 | 6/2001 | Te Kanawa | |
| 6,409,060 | B2 | 6/2002 | Donine | |
| 6,460,746 | B1 | 10/2002 | Amram | |
| 6,598,771 | B2 | 7/2003 | Norman | |
| 6,666,361 | B1 | 12/2003 | Lin | |
| 6,776,317 | B1 | 8/2004 | Parker | |
| 6,836,902 | B2 | 1/2005 | Marquez et al. | |
| 7,204,002 | B2 | 4/2007 | Kaneko et al. | |
| 7,322,498 | B2 | 1/2008 | Frost | |
| 7,356,850 | B2 | 4/2008 | Turcotte et al. | |
| 7,484,645 | B2 | 2/2009 | Hoff et al. | |
| 7,574,750 | B2 | 8/2009 | Harris | |
| D615,749 | S | 5/2010 | Wagner | |
| 7,780,587 | B2 | 8/2010 | Thornton et al. | |
| 7,819,831 | B2 * | 10/2010 | Dellanno | A61F 5/026 128/870 |
| 7,886,946 | B2 | 2/2011 | Gray | |
| 7,971,273 | B2 | 7/2011 | Grilliot et al. | |
| 8,028,871 | B2 | 10/2011 | Gray | |
| 8,267,290 | B2 | 9/2012 | Schlipper | |
| 8,272,507 | B1 | 9/2012 | Crump et al. | |
| 8,363,181 | B2 | 1/2013 | Nasu et al. | |
| 8,490,844 | B2 | 7/2013 | Favorito et al. | |
| 8,567,652 | B2 | 10/2013 | Di Stasio et al. | |
| 8,656,516 | B1 | 2/2014 | Reinhardt Rawlings et al. | |
| 8,973,794 | B2 | 3/2015 | Bergkvist et al. | |
| 9,017,226 | B2 | 4/2015 | Nash | |
| 9,038,868 | B2 | 5/2015 | Poiani | |
| 9,119,484 | B2 * | 9/2015 | Hyppolite | A47D 15/006 |
| 9,185,993 | B2 | 11/2015 | Telford et al. | |
| 9,277,830 | B2 | 3/2016 | Schachtner | |
| 9,357,852 | B2 | 6/2016 | Salazar et al. | |
| 9,439,516 | B2 | 9/2016 | Workman | |
| 9,498,007 | B2 | 11/2016 | Rizk | |
| 9,521,912 | B2 | 12/2016 | Yen | |
| 9,545,159 | B2 | 1/2017 | Wang | |
| 9,629,477 | B2 | 4/2017 | Tagle | |
| 9,848,713 | B2 * | 12/2017 | Rosen | A47D 13/025 |
| 9,949,575 | B2 * | 4/2018 | Pond | A47D 13/025 |
| 9,955,797 | B2 | 5/2018 | Telford et al. | |
| 10,172,437 | B2 | 1/2019 | Barber | |
| 2003/0172430 | A1 | 9/2003 | Jarrett | |
| 2003/0173150 | A1 | 9/2003 | Sharp | |
| 2004/0065708 | A1 | 4/2004 | Amram | |
| 2004/0149790 | A1 * | 8/2004 | Kassai | A47D 13/02 224/160 |
| 2005/0045674 | A1 * | 3/2005 | Rehbein | A47D 13/025 224/160 |
| 2007/0029356 | A1 | 2/2007 | Moriguchi et al. | |
| 2007/0125815 | A1 | 6/2007 | Tong | |
| 2007/0254129 | A1 | 11/2007 | Horblitt | |
| 2008/0185409 | A1 | 8/2008 | Kellenberger | |
| 2009/0206116 | A1 | 8/2009 | Grant | |
| 2009/0302075 | A1 | 12/2009 | Trainer | |
| 2010/0147910 | A1 | 6/2010 | Schachtner | |
| 2011/0062195 | A1 * | 3/2011 | Jones | A47D 13/025 224/161 |
| 2011/0185477 | A1 | 8/2011 | Olenicoff | |
| 2012/0152987 | A1 | 6/2012 | Beltrame et al. | |
| 2013/0240590 | A1 | 9/2013 | Montgomery | |
| 2014/0361055 | A1 | 12/2014 | Myers | |
| 2015/0101108 | A1 | 4/2015 | Wallace | |
| 2015/0181953 | A1 | 7/2015 | Brown | |
| 2015/0201761 | A1 | 7/2015 | Wollenberg | |
| 2016/0150893 | A1 | 6/2016 | Salazar et al. | |
| 2017/0119173 | A1 | 5/2017 | Telford | |
| 2018/0116426 | A1 * | 5/2018 | Telford | A47D 13/025 |
| 2018/0125124 | A1 | 5/2018 | Jylkka-Tesler | |
| 2018/0184813 | A1 * | 7/2018 | Salazar | A47D 13/025 |
| 2018/0206653 | A1 * | 7/2018 | Andrus | A47D 13/025 |
| 2019/0014920 | A1 * | 1/2019 | Matsuyama | A47D 13/025 |
| 2019/0038044 | A1 | 2/2019 | Cummings | |
| 2019/0075937 | A1 * | 3/2019 | Salazar | A47D 13/025 |
| 2019/0075939 | A1 * | 3/2019 | Plested | A45F 3/14 |
| 2019/0216232 | A1 * | 7/2019 | Kee | A47D 13/025 |

OTHER PUBLICATIONS

Final Office Action, dated Oct. 30, 2019, from corresponding U.S. Appl. No. 15/861,546.

International Search Report, dated Feb. 7, 2020, from corresponding International Application No. PCT/US2019/054466.

Notice of Allowance, dated Jan. 21, 2020, from corresponding U.S. Appl. No. 15/861,546.

Office Action, dated Jul. 15, 2019, from corresponding U.S. Appl. No. 15/861,546.

Office Action, dated Jun. 22, 2018, from corresponding U.S. Appl. No. 15/861,546.

Office Action, dated Jun. 27, 2018, from corresponding U.S. Appl. No. 15/861,512.

Restriction Requirement, dated Feb. 28, 2018, from corresponding U.S. Appl. No. 15/861,546.

Restriction Requirement, dated Mar. 1, 2018, from corresponding U.S. Appl. No. 15/861,512.

Written Opinion of the International Searching Authority, dated Feb. 7, 2020, from corresponding International Application No. PCT/US2019/054466.

Invitation to Pay Additional Fees, dated Dec. 12, 2019, from corresponding International Application No. PCT/US19/54466.

* cited by examiner

CHILD CARRYING SYSTEM

CROSS-REFERENCE TO RELATED APPLICATIONS

This application claims the benefit of U.S. Provisional Patent Application Ser. No. 62/740,811, filed on Oct. 3, 2018, and entitled "CHILD CARRYIING SYSTEM," the contents of which are hereby incorporated by reference herein.

BACKGROUND

Devices for carrying a baby or toddler typically require a one-piece device that straps to the adult and forms a seat for allowing the child to be carried by the adult. However, these devices are cumbersome in that they often hang from the adult when the child wishes to walk instead of being carried and are difficult to remove when not in use. Moreover, the child cannot be easily inserted and removed from the device since it requires unstrapping of the device to insert or remove the child from the carried position. In addition, conventional devices put an undue amount of strain on the adult's shoulders and hips due to the load distribution that is inherent with traditional device designs. Various embodiments of the present child carrying system recognize and address the foregoing considerations, and others, of prior art devices.

SUMMARY

It should be appreciated that this Summary is provided to introduce a selection of concepts in a simplified form that are further described below in the Detailed Description. This Summary is not intended to be used to limit the scope of the claimed subject matter.

According to one aspect of the disclosure, a dual-wrap garment configured to be worn by a person for carrying a child includes a primary wrap, a number of stays, a secondary wrap, and a number of releasable attachments secured to the primary wrap for engaging corresponding attachments of a child support. The primary wrap has first and second ends with a back segment between. The primary wrap is configured to encircle the person such that when the back segment is positioned against a back of the person, the first and second ends wrap around the person's torso and secures at the front of the person. The stays extend vertically between top and bottom edges of the back segment and include a semi-rigid material to provide flexible support to the back segment. The secondary wrap includes first and second compression straps, each having a first end attached to the primary wrap and an opposite adjustment end. The adjustment ends are configured to wrap around the person's torso over the primary wrap and secure at the front.

According to another aspect of the disclosure, a dual-wrap child carrying system is configured to be worn by a person for carrying a child. The system includes a primary wrap, a number of stays, a secondary wrap, and a number of releasable attachments secured to the primary wrap. The primary wrap has first and second ends with a back segment between. The primary wrap is configured to encircle the person such that when the back segment is positioned against a back of the person, the first and second ends wrap around the person's torso and secures at the front of the person. The stays extend vertically between top and bottom edges of the back segment and include a semi-rigid material to provide flexible support to the back segment. The secondary wrap is configured to encircle the person over the primary wrap and includes first and second compression straps, each having a first end attached to the primary wrap and an opposite adjustment end. The system also includes a child support having a fabric receptacle sized and shaped for a posterior of the child, and a number of releasable attachments configured to engage the attachments secured to the primary wrap, including a pair of upper child support releasable attachments and a pair of lower child support releasable attachments. The child support is configured such that when the releasable attachments of the primary wrap are engaged with the releasable attachments of the fabric receptacle with the child positioned within the fabric receptacle, the legs of the child are disposed between the pair of upper and the pair of lower child support releasable attachments and the shoulders of the child are positioned above all of the child support releasable attachments.

According to a further aspect of the disclosure, a dual-wrap child carrying system is configured to be worn by a person for carrying a child. The system includes a dual-wrap garment and a child support configured to releasably attach to the dual-wrap garment. The dual-wrap garment includes a primary wrap, a number of stays, and a secondary wrap. The primary wrap is configured to encircle the person and secure at a front side of the person. The secondary wrap includes a stretchable textile having a higher elasticity than a material of the primary wrap. The stays extend vertically between a top edge and a bottom edge of a back segment and comprising a semi-rigid material configured to provide flexible support to the back segment.

BRIEF DESCRIPTION OF THE DRAWINGS

Various embodiments of the disclosure will be described below. In the course of the description, reference will be made to the accompanying drawings, which are not necessarily drawn to scale, and wherein.

DETAILED DESCRIPTION OF VARIOUS EMBODIMENTS

Various embodiments will now be described more fully hereinafter with reference to the accompanying drawings. It should be understood that the concepts disclosed herein may be embodied in many different forms and should not be construed as limited to the embodiments set forth herein. Rather, these embodiments are provided so that this disclosure will be thorough and complete, and will fully convey the scope of the disclosure to those skilled in the art. Like numbers refer to like elements throughout.

Conventional soft structured child carriers distribute the weight of the child to the adult's hips and shoulders. Due to physical limitations and comfort considerations, many people are unable to support the weight of the child in these areas for extensive, or any, length of time. The cumbersome or complex nature of conventional carriers often makes them difficult to put on, and difficult to put the child in, without assistance from others. Moreover, because conventional child carriers utilize load bearing shoulder straps, these bulky straps may impede the arm movement of the adult wearing the carrier, often making it difficult for the adult to have a full range of motion of their arms while wearing the carrier.

The concepts and technologies described herein utilize a dual-wrap child carrying system that includes a dual-wrap garment and a removable child support for securing the child to the dual-wrap garment. The dual-wrap garment includes a primary wrap that wraps around the wearer's torso, grounding the dual-wrap garment to the wearer's body while correctly sizing and securing the wrap to the wearer. The dual-wrap garment also includes a secondary wrap that provides compression to properly distribute the load from the child through the wearer's core and back.

The dual-wrap garment and corresponding child support provides significant advantages and benefits over conventional child carriers. First, because of the dual-wrap aspect of having a primary wrap that secures around a wearer's torso, while having a secondary wrap that stretches around the torso to provide a compressive force, the resulting dual-wrap garment is extremely comfortable. When worn without the child support attached, the dual-wrap garment provides comfort, postural support, and even slimming aesthetic benefits not found with conventional carriers. Flexible stays are positioned within a back segment of the dual-wrap garment. When the secondary wrap is pulled and secured around the wearer's torso, the flexible stays conform to the curvature of the wearer's back or spine, distributing the load of a child around the wearer's core to the wearer's back. As a result, the load of a child is not taken by a user's shoulders or upper back, as is done with conventional carriers.

Figure 1A:
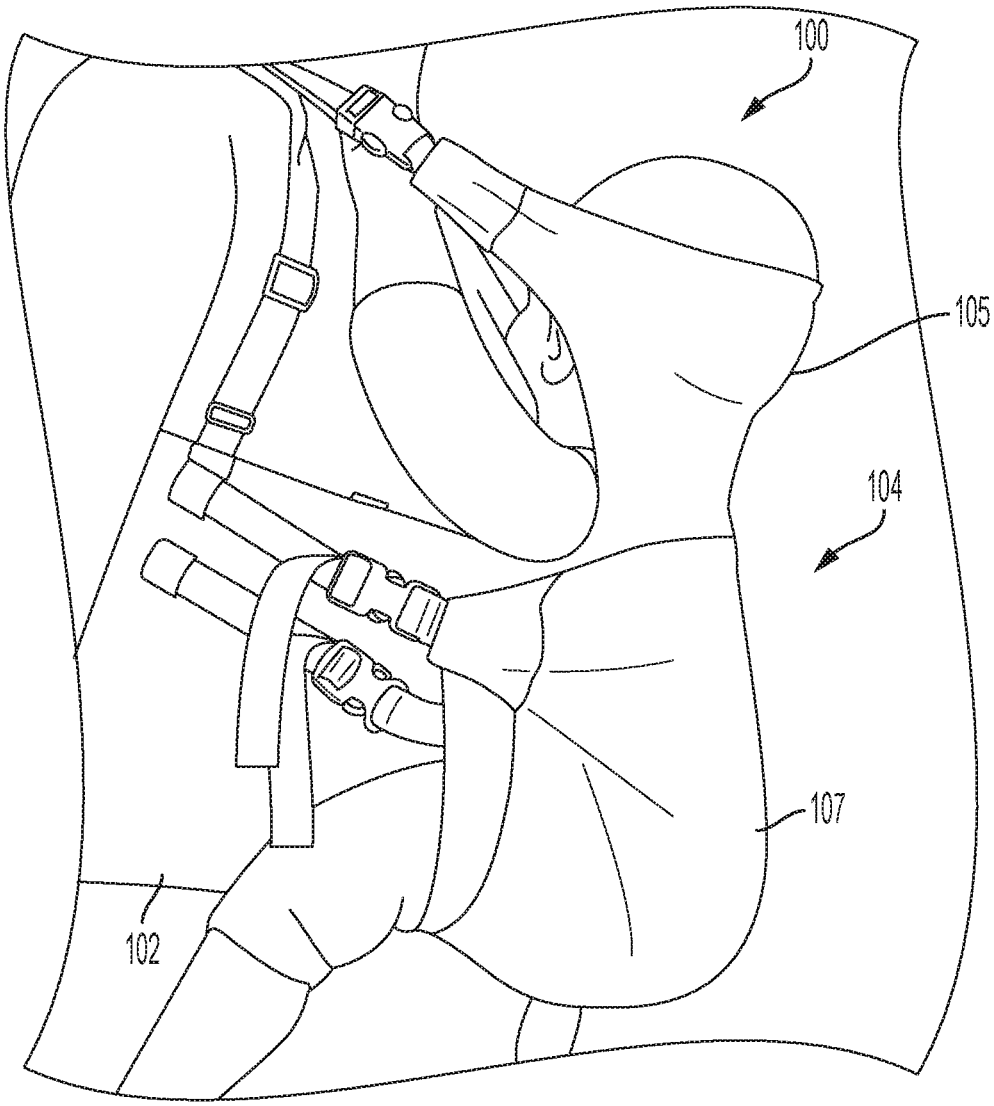
FIG. 1A is a perspective view of a dual-wrap garment with an attached child support having an upper body support, the garment and child support in use and supporting a child, according to various embodiments described herein.

Referring now to FIGS. 1A-15, aspects of the dual-wrap child carrying system 100 will be discussed in detail. According to various embodiments, the dual-wrap child carrying system 100 includes a dual-wrap garment 102 worn by an adult and a child support 104 that is releasably attachable to the dual-wrap garment 102 and configured to support a child. FIG. 1A shows the dual-wrap garment 102 worn by the adult with the child support 104 attached and a child being supported within. According to this embodiment, the child support 104 includes an upper body support 105 coupled to a lower body support 107. The upper body support 105 provides additional material and support for a child as he or she grows. When carrying an infant or very small child, the upper body support 105 is useful for supporting the child's head and neck of when the child does not have sufficient neck strength yet to support his or her head for a long period of time, as shown in FIG. 1A. The upper body support 105 may also be used to support the head and neck of a sleeping child.

Figure 1B:
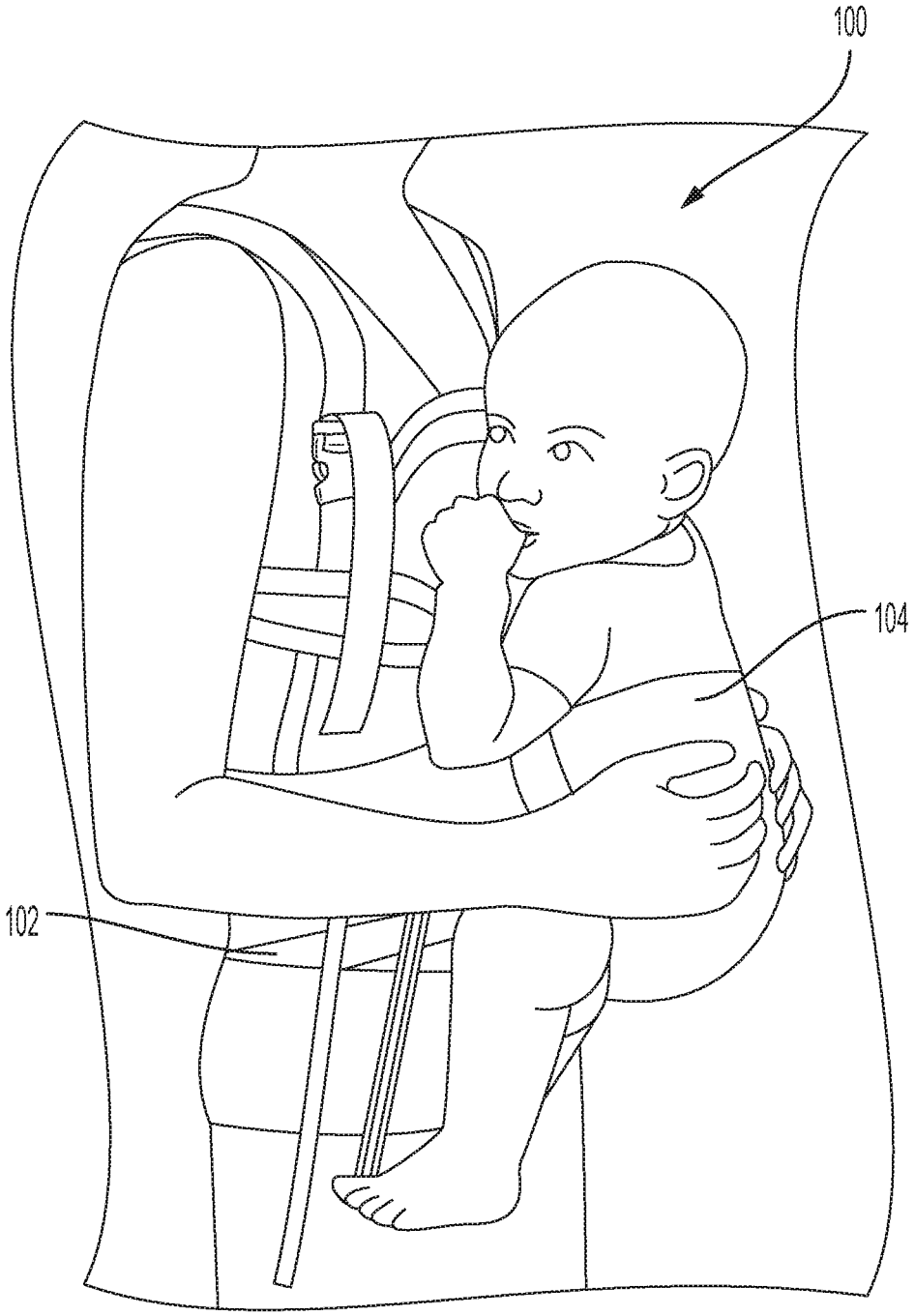
FIG. 1B is a perspective view of a dual-wrap garment with an attached child support, but without an upper body support, according to various embodiments described herein.
Figure 13:
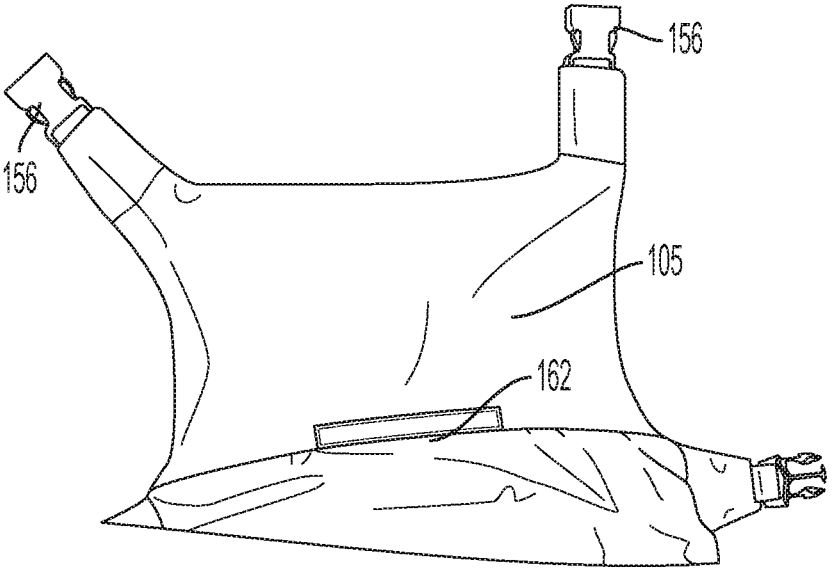
FIG. 13 is a close-up view of an upper body support compartment of a child support, illustrating a closed configuration with upper body support accessible, according to various embodiments described herein.
Figure 14:
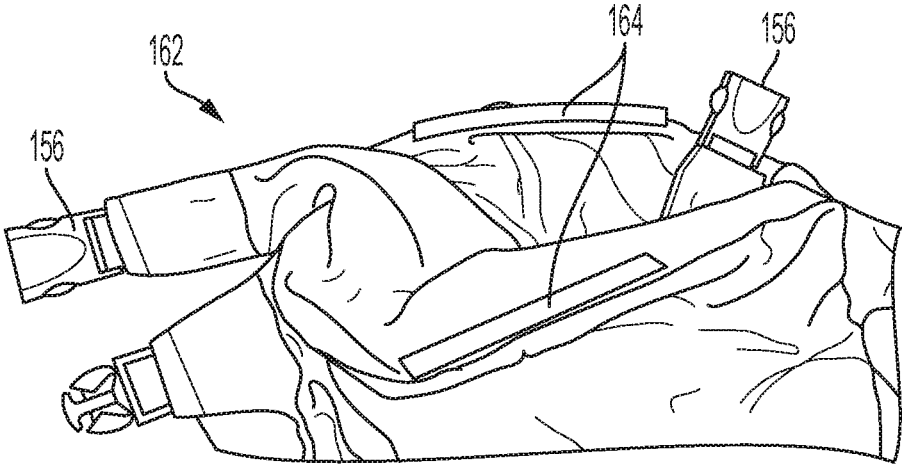
FIG. 14 is a close-up view of an upper body support compartment of a child support, illustrating an open configuration with upper body support at least partially stowed, according to various embodiments described herein.

FIG. 1B shows an alternative embodiment or configuration of the child support 104 in which the child support 104 does not have an upper body support 105, or the upper body support 105 is stowed within a compartment, as described in greater detail below with respect to FIGS. 13 and 14. This configuration is useful when the child is of the appropriate size to be fully supported by the lower body support 107, while allowing a greater freedom of movement of the child's upper body and arms. As the child grows even taller, the upper body support 105 may again be used to provide additional support for the larger child's upper body, covering the child's upper back and even shoulders while allowing the child full freedom of unrestricted head movement. In this manner, the dual-wrap child carrying system 100 is fully functional for a wide range of child ages and sizes, adapting the child's size as the child grows.

Figure 2:
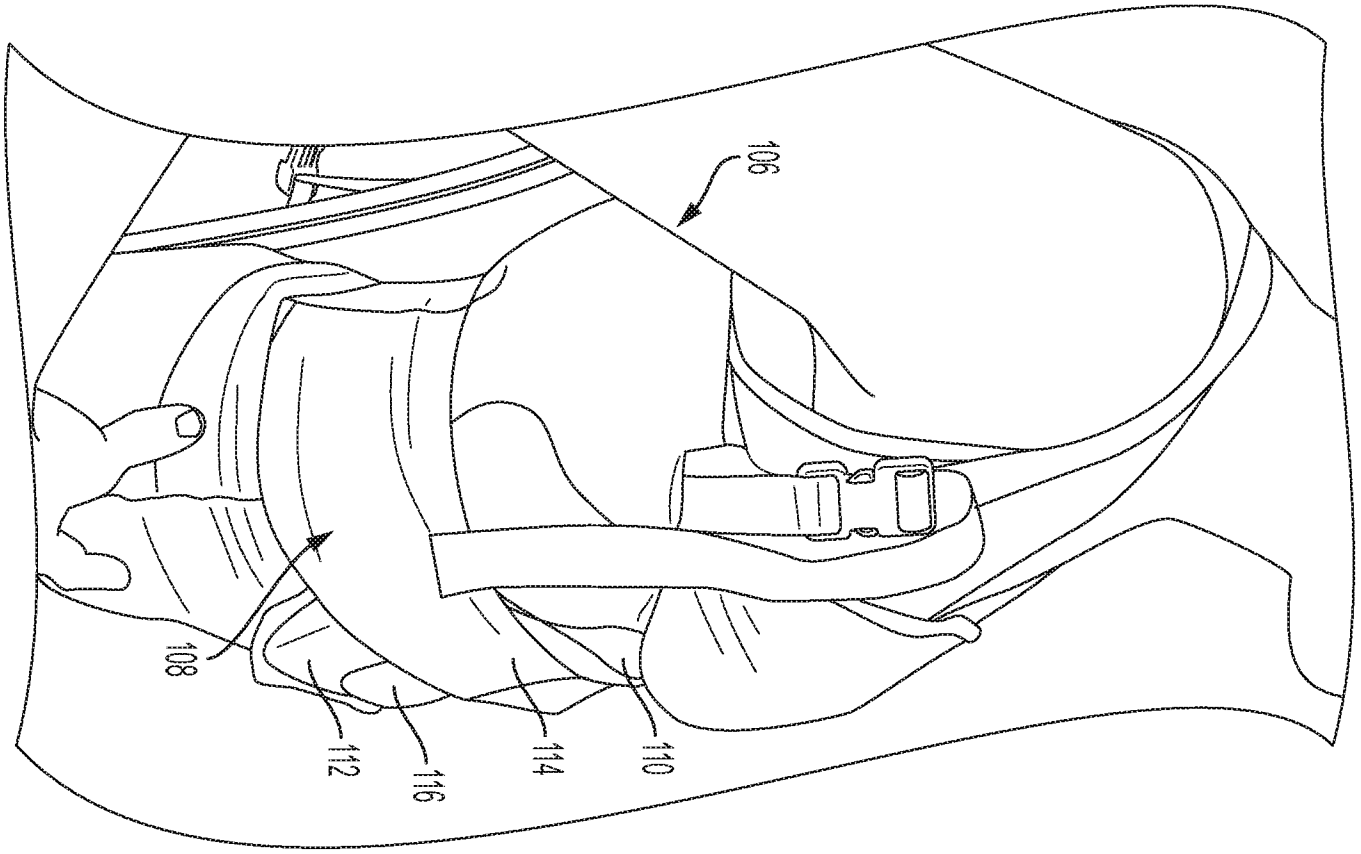
FIG. 2 is a side view of a dual-wrap garment worn by an adult without a child support attached, according to various embodiments described herein.
Figure 3:
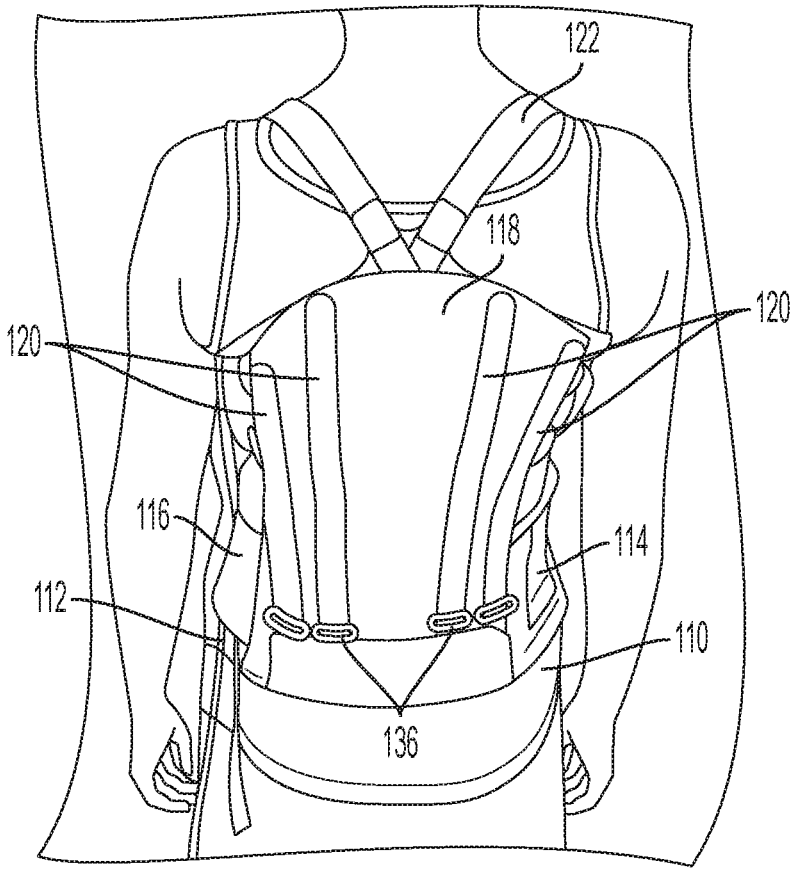
FIG. 3 is a rear view of a dual-wrap garment worn by an adult, according to various embodiments described herein.
Figure 4:
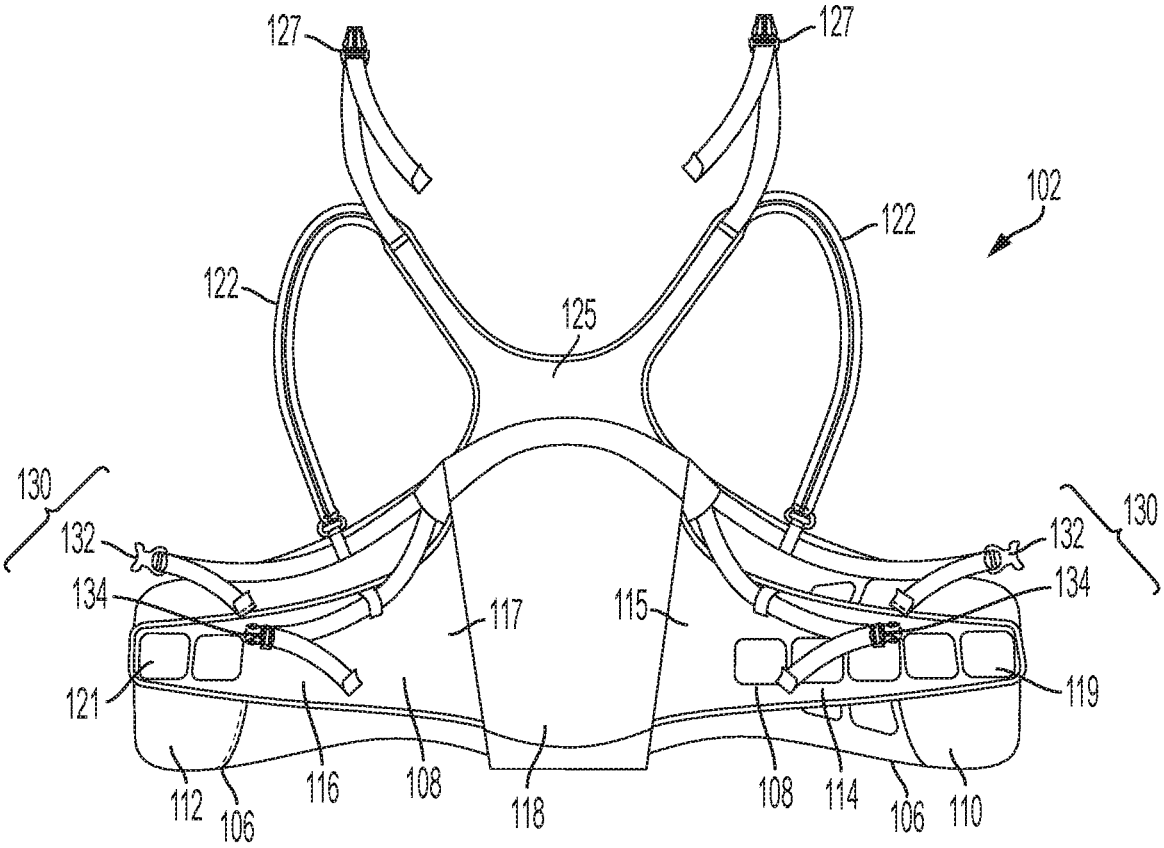
FIG. 4 is a rear view of a dual-wrap garment opened and without a child support attached, according to various embodiments described herein.
Figure 5:
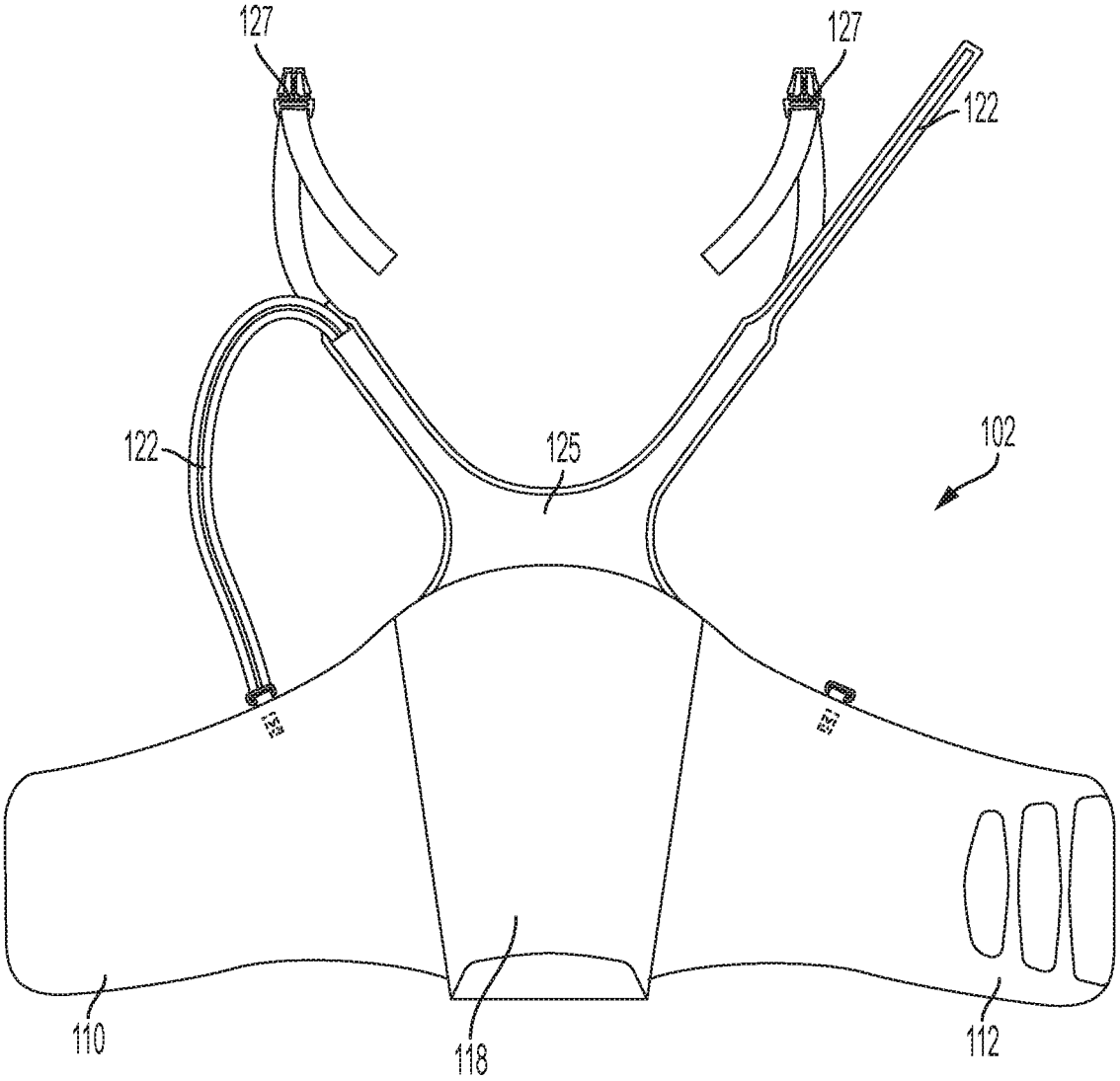
FIG. 5 is a front view of a dual-wrap garment opened and without a child support attached, according to various embodiments described herein.

Various aspects of the dual-wrap garment 102 will now be described with respect to FIGS. 2-5. FIGS. 2 and 3 show the dual-wrap garment 102 being worn, while FIGS. 4 and 5 show rear and front views of the dual-wrap garment 102 in an open configuration. The dual-wrap garment 102 includes a primary wrap 106 that encircles and tightens around the wearer's torso to properly size the dual-wrap child carrying system 100 to the wearer's body. The primary wrap 106 can be described as having a first end 110 and a second end 112 with a back segment 118 disposed between such that when the back segment 118 is positioned adjacent to a back of the person, the first end 110 and the second end 112 wrap around a torso of the person and secure at a front side of the person, as best seen in FIG. 2.

According to one embodiment, to secure the first end 110 and the second end 112 to the front side of the person, an inside surface of the first end 110 may include an engagement material (e.g., Velcro or other hook and loop fastener system, straps, a zipper, buttons or any other suitable fastener) configured to secure the first end 110 to an outside surface of the primary wrap 106 when encircling the person and overlapping an outside surface of the second end 112. Alternatively, according to another embodiment, an inside surface of the second end 112 may include the engagement material configured to secure the second end 112 to the outside surface of the primary wrap 106 when encircling the person and overlapping an outside surface of the first end 110. While described as having three panels (i.e., the first end 110, the second end 112, and the back segment 118), it should be appreciated that the primary wrap 106 may be configured with any number of panels, including being a single piece of material. The primary wrap 106 may be formed from any suitable material such as cotton, nylon, rayon, a polymer blend or any other suitable blend of materials depending on the application.

As shown in FIG. 3, the dual-wrap garment 102 includes a number of stays 120 disposed within the back segment 118. The stays 120 provide numerous benefits to the dual-wrap garment 102. As will be described below in greater detail, the stays 120 provide flexible support to the dual-wrap garment 102, conforming to the wearer's back when the dual-wrap garment 102 is secured for use. The stays 120 additionally properly position the releasable attachments 130 secured to the primary wrap 106 for engaging a plurality of child support releasable attachments 150 coupled to a child support 104.

The stays 120 and associated structure of the dual-wrap garment 102 will be discussed with respect to FIGS. 3 and 6-8B. The examples shown in these figures show four stays 120 arranged substantially parallel to one another, or in parallel pairs, and extending vertically substantially between a top edge and a bottom edge of the back segment 118. Each stay 120 is manufactured from a semi-rigid material configured to provide flexible support to the back segment 118. The stays 120 are bendable batons that are inserted into stay pockets 128 created within the back segment 118 to guide and retain the stays in place within the dual-wrap garment 102. According to various embodiments, the stays 120 may be manufactured from high-density polyethylene (HDPE), fiberglass, thermosets, and/or any suitable polymer, composite, or other material configured to provide semi-rigid support to the back segment 118.

Figure 6:
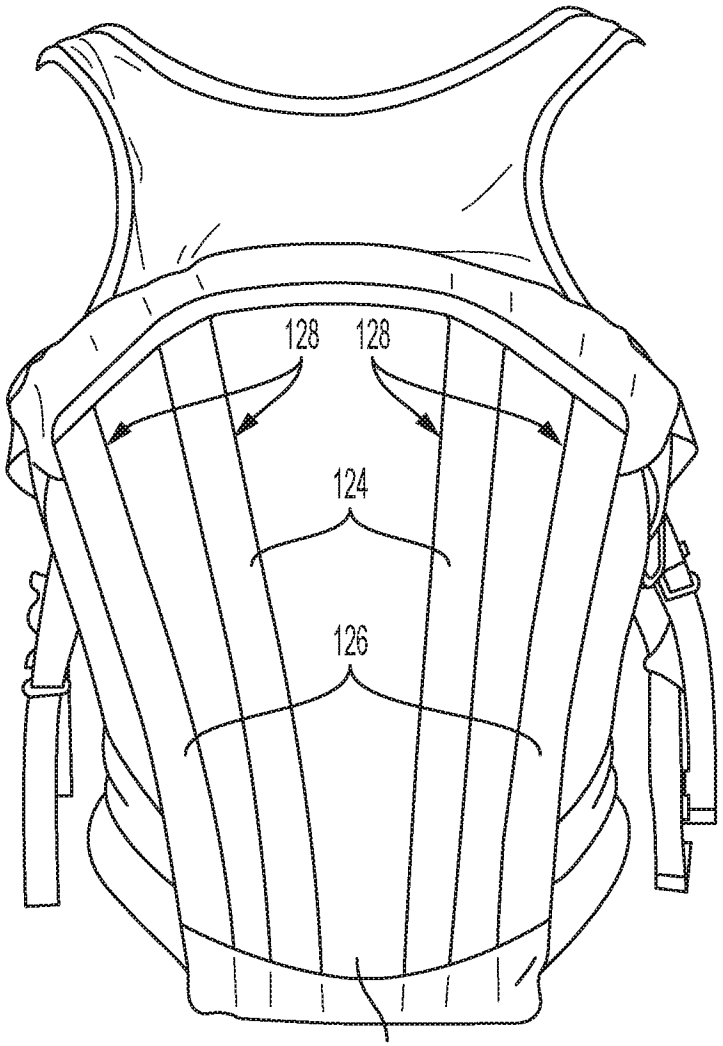
FIG. 6 is a rear view of a dual-wrap garment in a closed configuration, illustrating aspects of the stays and corresponding stay pockets, according to various embodiments described herein.

As best seen in FIGS. 4 and 6, the embodiment shown includes a pair of inner stays 124 and a pair of outer stays 126. Generally, the height of the stays 120 compliment the curvature of the top edge of the back segment 118. Consequently, according to this example, the inner stays 124 are longer than the pair of outer stays 126 since the distance between top and bottom edges of the back segment 118 is greatest in the center to assist with distributing the load from the attached child through the wearer's mid-back and thoracic cavity.

Figure 7A:
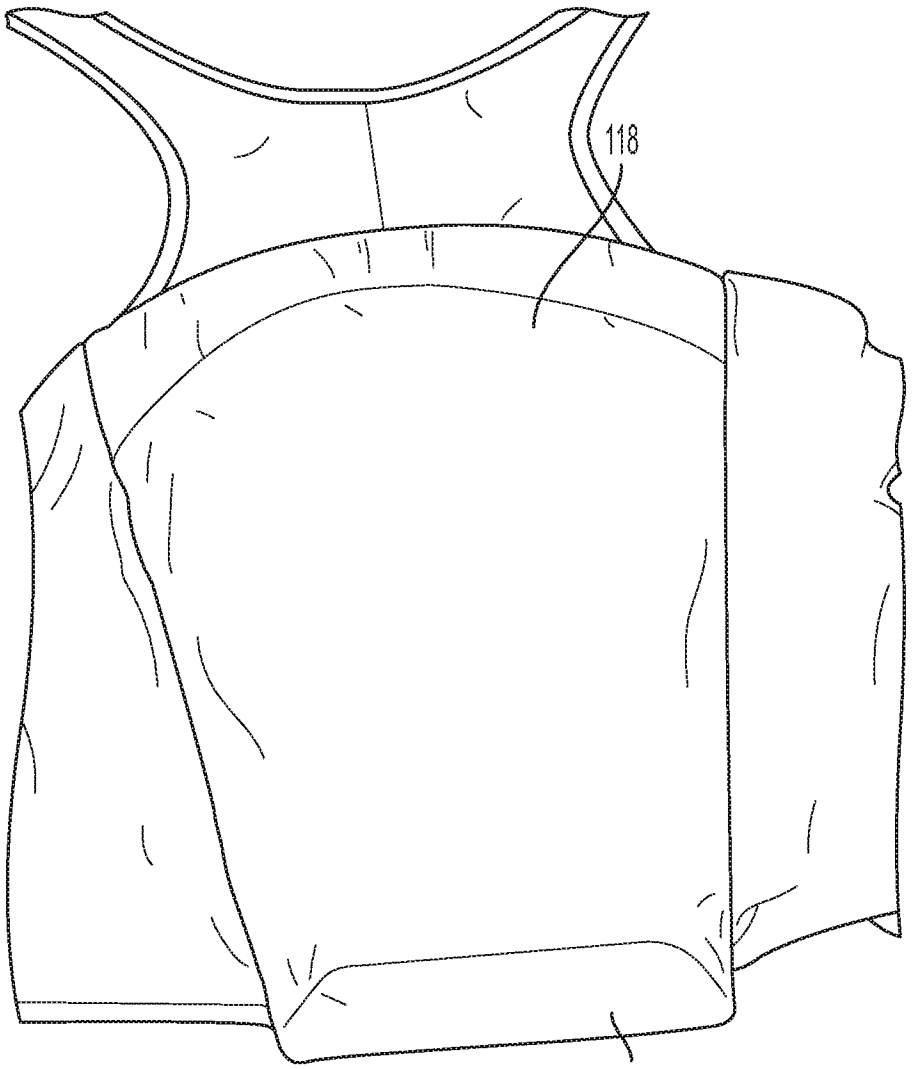
FIG. 7A is a close-up front view of a back segment of a dual-wrap garment, according to various embodiments described herein.

FIGS. 6 and 7 show rear and front views of the back segment 118 of the dual-wrap garment 102. FIG. 6 shows the stays 120 positioned within stay pockets 128. The stay pockets 128 are sewn or otherwise positioned within the back segment 118. Each stay pocket 128 is configured to receive a stay 120 that may be slid into the pocket for use and pulled out of the pocket when washing the dual-wrap garment 102 or for replacement with an alternative stay 120 having different desired properties or characteristics. To access the stay pockets 128 inside the back segment 118, a stay compartment 138 is accessed via the compartment access 137. The compartment access 137 may include a flap or tab of material that is sewn to or otherwise an extension of the material of the back segment 118. The flap or tab of material may include any mechanism for opening and closing the stay compartment 138 to access the stay pockets 128, including but not limited to Velcro, zippers, buttons, snaps, or any other type of suitable fasteners.

Figure 7B:
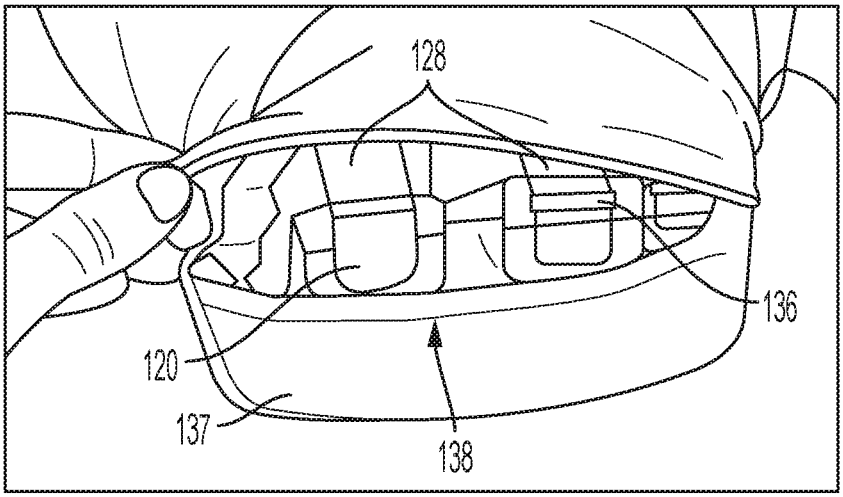
FIGS. 7B and 7C are close-up views of a stay compartment in a back segment of a dual-wrap garment, illustrating details with respect to a plurality of stay pockets, stays, and corresponding compartment access, according to various embodiments described herein.
Figure 7C:
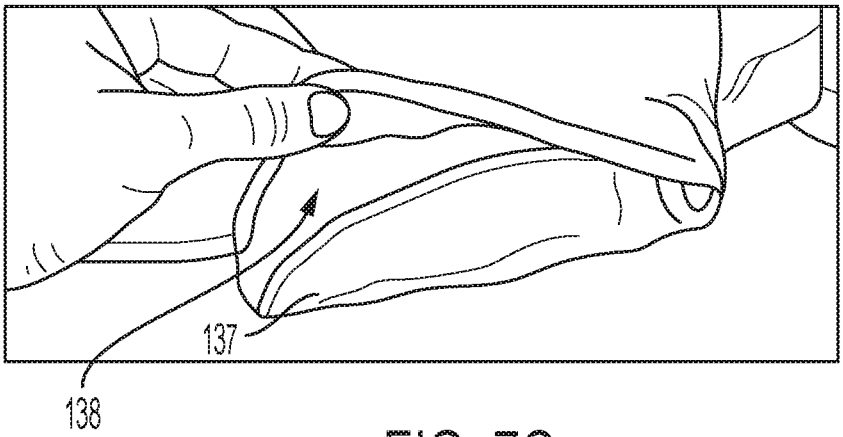
Figure 8B:
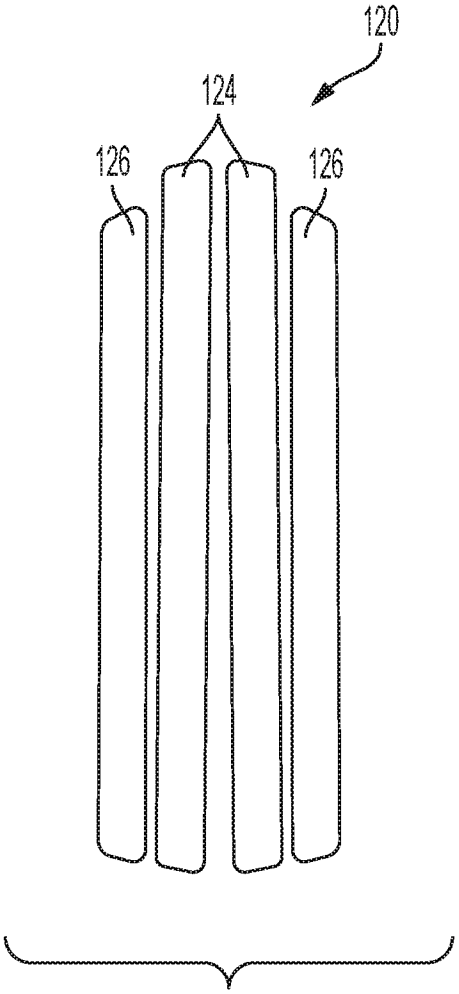
FIG. 8B is a front view of a plurality of stays, according to various embodiments described herein.
Figure 8A:
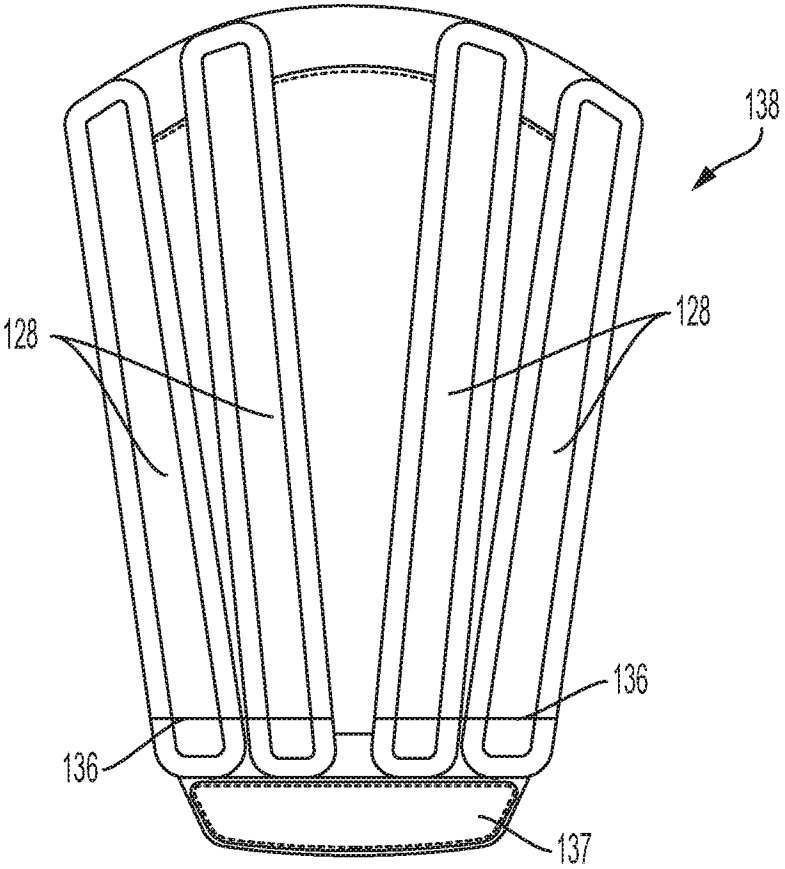
FIG. 8A is a view of an interior of a stay compartment in a back segment of a dual-wrap garment, according to various embodiments described herein.

FIG. 7B shows the compartment access 137 opened to expose the stay compartment 138 within the interior of the back segment 118 where the stay pockets 128 are positioned. Each stay pocket 128 has an aperture 136 through which the corresponding stay 120 may be removed and replaced. FIG. 7C shows the compartment access 137 being closed for use of the dual-wrap garment 102. In this embodiment, the compartment access 137 is folded inside the back segment 118 and secured in the closed configuration with a hook and loop fastener. FIG. 8A shows an interior of a stay compartment 138 in the back segment 118 of a dual-wrap garment 120, with the outer material of the back segment 118 removed for clarity purposes. In this view, the stay pockets 128 are clearly seen, with apertures 136 positioned proximate to the compartment access 137 for easy insertion and removal of the stays 120 shown in FIG. 8B. According to an alternative embodiment shown in FIG. 3, the stay pockets 128 are accessed via apertures 136 in the rear side of the back segment 118 rather than within a stay compartment 138 as described above. Any method of removing and replacing the stays 120 from the stay pockets 128 may be used without departing from the scope of this disclosure.

Because embodiments allow for the removal and replacement of the stays 120, different stays 120 having various properties may be used according to the wearer's personal needs or preferences. For example, the length, thickness, elasticity, stiffness, weight, number, and any other applicable characteristics may be customized according to the wearer and/or the child. A tall, strong person may need or prefer stays 120 having a stiffness that is different than the stiffness desired by a short, weaker person. Similarly, the size or age of the child being carried may alter the desired characteristics of the stays 120. According to other embodiments, the characteristics of the stays 120 may be predetermined to satisfy a majority of wearers under a majority of circumstances such that the dual-wrap child carrying system 100 may be used by any wearer without modification.

As discussed above, the stays 120 may be flexible. Flexibility allows the stays 120 to bend when the dual-wrap garment 102 is pulled tight so that the stays 120 conform to the curvature of the wearer's back or spine. In doing so, the load placed on the dual-wrap garment 102 when a child is placed in the dual-wrap child carrying system 100 is distributed around the wearer's core and through the stays 120 to the wearer's back.

The mechanism that pulls the stays 120 inward to conform against the wearer's back is a secondary wrap 108 of the dual-wrap garment 102, which is best seen in FIGS. 4 and 5. The secondary wrap 108 provides a compressive force that tightens the dual-wrap garment 102 around the torso of the wearer, pulling the stays 120 against the wearer's back and creating a dual-wrap garment 102 that is tightly or snugly fit around the wearer.

The secondary wrap 108 includes a first compression strap 114 having a first compression strap fixed end 115 coupled to the primary wrap 106 and an opposite first compression strap adjustment end 119 that is used to pull the first compression strap 114 tight before securing the strap to the primary wrap 106 on the front side of the wearer. Similarly, the secondary wrap 108 includes a second compression strap 116 having a second compression strap fixed end 117 coupled to the primary wrap 106 and an opposite second compression strap adjustment end 121 that is used to pull the first compression strap 114 tight before securing the strap to the primary wrap 106 on the front side of the wearer. The first strap fixed end 115 of the first compression strap 114 and the second strap fixed end 117 of the second compression strap 116 are coupled to opposite edges of the back segment 118 of the primary wrap 106. In doing so, as the wearer pulls on and secures the first compression strap adjustment end 119 and the second compression strap adjustment end 121, the back segment 118 is pulled inward toward the wearer and the stays 120 are flexed to conform to the wearer's back curvature. FIG. 2 shows the dual-wrap garment 102 in a secured configuration in which the primary wrap 106 and the secondary wrap 108 are both secured around the wearer's torso.

To secure the dual-wrap garment 102, after the inside surface of the first end 110 or the second end 112 of the primary wrap 106 is secured to the outside surface of the corresponding second end 112 or first end 110, respectively, the secondary wrap 108 is pulled tight and secured to the primary wrap 106. An inside surface of the first compression strap adjustment end 119 has an engagement material configured to secure the first compression strap adjustment end 119 to the outside surface of the primary wrap 106. Additionally, an inside surface of the second compression strap adjustment end 121 comprises an engagement material configured to secure the second compression strap adjustment end 121 to the outside surface of the primary wrap 106. FIG. 2 shows an example of the secondary wrap 108 secured around the wearer and to the primary wrap 106. It should be appreciated that the ends of the secondary wrap 108 may alternatively overlap and secure to an outside surface of an opposing end of the secondary wrap 108 rather than directly to the primary wrap 106.

The secondary wrap 108 may be manufactured from a stretch woven material or any suitable stretchable textile that has a higher elasticity than the material of the primary wrap 106. According to various embodiments, the secondary wrap 108 has a greater return than the primary wrap 106 such that the secondary wrap 108 may elongate a similar amount as the primary wrap 106 in response to a similar force, but the secondary wrap 108 has a greater return characteristic when the force is released. This elastic property of the secondary wrap 108 provides the compressive force around the wearer's torso when the dual-wrap garment 102 is worn to conform the stays 120 to the wearer's back and adequately distribute the load to the wearer's back and core. In this manner, the wearer carries the child with a load distribution similar to that of a pregnant woman. The secondary wrap 108 acts like muscles that are anchored to the stays 120 that distribute the weight through the wearer's back.

According to one embodiment, the dual-wrap garment 102 may include one or more shoulder straps 122 secured to the primary wrap 106. Each shoulder strap 122 may be coupled to primary wrap 106 at one end and coupled to a shoulder yoke 125 of the dual-wrap garment 102 at an opposite end. Unlike conventional carriers, the shoulder straps 122 of the various embodiments herein are not load bearing. Rather, the weight of the child is carried through the wearer's back and core instead of the wearer's shoulders. The shoulder straps 122 of the various embodiments are used for comfort purposes and to assist in maintaining the dual-wrap garment 102 in place. The shoulder straps 122 may be optional. Upper body support releasable attachments 127 may be coupled to the shoulder yoke 125 for connection to the upper body support 105 of the child support 104 when an upper body support is used (e.g., FIG. 1).

Figure 9:
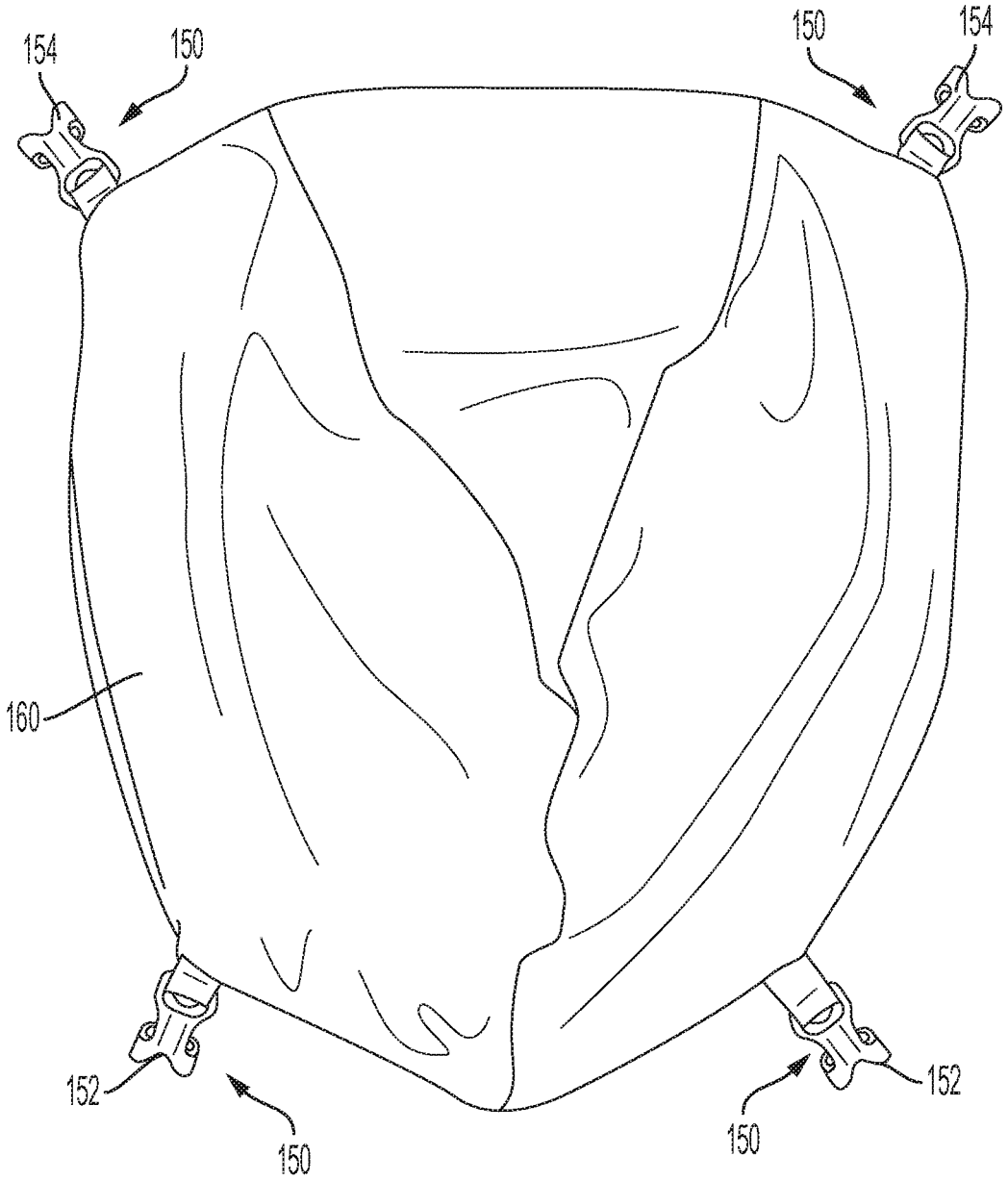
FIG. 9 is a rear view of a child support without upper body support, according to various embodiments described herein.
Figure 10:
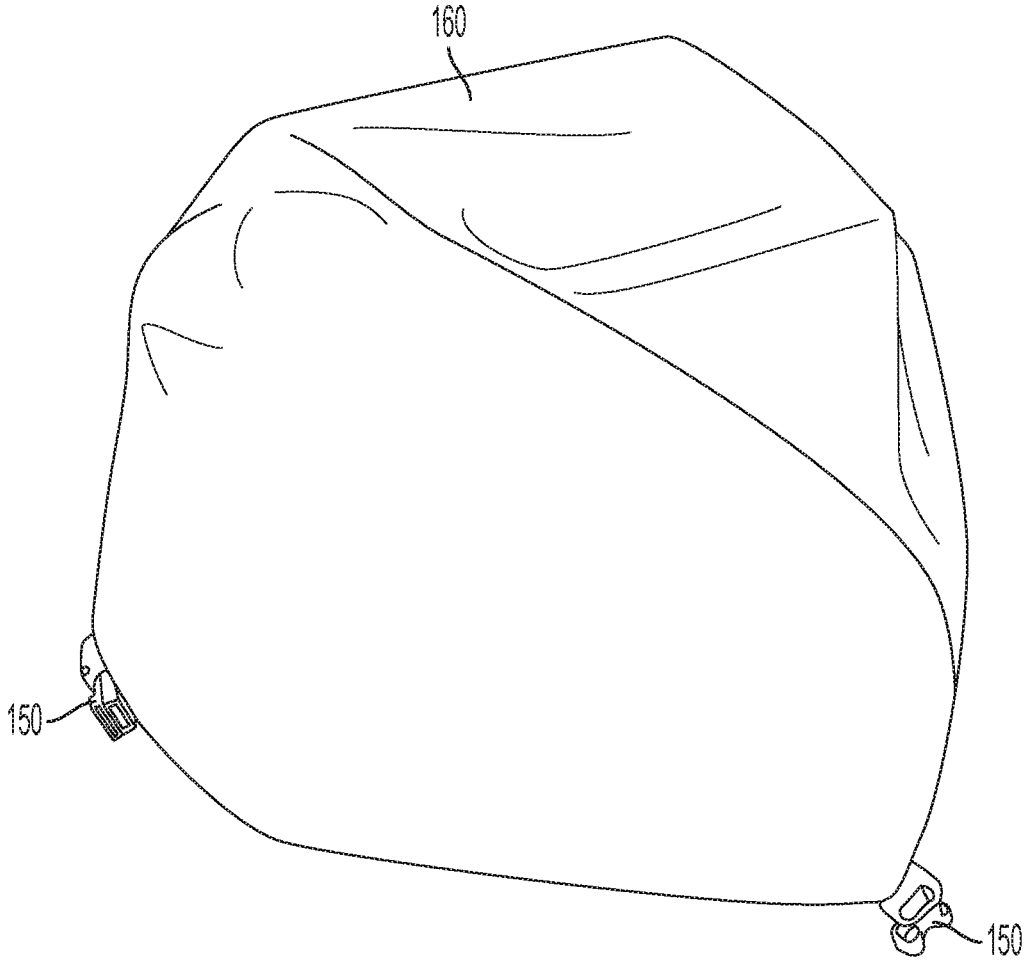
FIG. 10 is a perspective view of a child support without upper body support, according to various embodiments described herein.

As mentioned above, the stays 120 additionally properly position the releasable attachments 130 secured to the primary wrap 106 for engaging a plurality of child support releasable attachments 150 coupled to a child support 104. The releasable attachments 130 are shown in FIG. 4. According to various embodiments, the releasable attachments 130 include a pair of upper releasable attachments 132 and a pair of lower releasable attachments 134. Additionally, the releasable attachments 130 may also include upper body support releasable attachments 127 when upper body supports 105 are used. Each of the releasable attachments 130, or any number of the releasable attachments 130, may be adjustable so that the length of the attachment strap may be lengthened or shortened to accommodate children of different sizes or to secure the child against the adult with a desired force. According to one embodiment, rel FIGS. 9 and 10 show a child support 104 that is configured to secure a child between the child support 104 and the dual-wrap garment 102. According to various embodiments, the child support 104 includes a fabric receptacle 160 sized and shaped for abutment with a posterior of the child. The fabric receptacle 160 creates a pocket that cradles and supports the child when the child support 104 is engaged with the dual-wrap garment 102. The fabric receptacle 160 may be manufactured from any suitable breathable fabric. The fabric may be porous to allow for air flow and to increase comfort for the child. The fabric receptacle 160 may be made from a single panel of material or multiple panels of material.

The child support 104 secures to the dual-wrap garment 102 via child support releasable attachments 150. Specifically, according to one embodiment, a pair of upper child support releasable attachments 152 of the child support 104 are configured to engage with the pair of upper releasable attachments 132 of the dual-wrap garment 102, and a pair of lower child support releasable attachments 154 of the child support 104 are configured to engage with the pair of lower releasable attachments 134 of the dual-wrap garment 102.

When using the dual-wrap child carrying system 100, the wearer wraps the primary wrap 106 around the wearer's torso and secures the first end 110 to the second end 112, or vice versa. The wearer then pulls the secondary wrap 108 tight and secures the first compression strap 114 and the second compression strap 116 to provide a compressive force around the dual-wrap garment 102. The shoulder straps 122 may optionally be secured in place. The wearer then attaches the pair of lower child support releasable attachments 154 of the child support 104 to the pair of lower releasable attachments 134 of the dual-wrap garment 102. One of the upper child support releasable attachments 152 of the child support 104 is attached to the corresponding upper releasable attachment 132 of the dual-wrap garment 102. The child may then be placed in the child support through the opening provided by remaining open attachments, with the posterior of the child resting in the fabric receptacle 160 and the child's legs placed over the lower straps of the lower releasable attachments 134 of the dual-wrap garment 102. The final upper child support releasable attachment 152 of the child support 104 is then coupled to the corresponding upper releasable attachment 132 of the dual-wrap garment 102 and the straps are tightened a desired amount. If using an upper body support 105, the upper body support may be removed from stowage and secured to the upper body support releasable attachments 127 via the corresponding buckles or fasteners on the upper body support 105.

Figure 11:
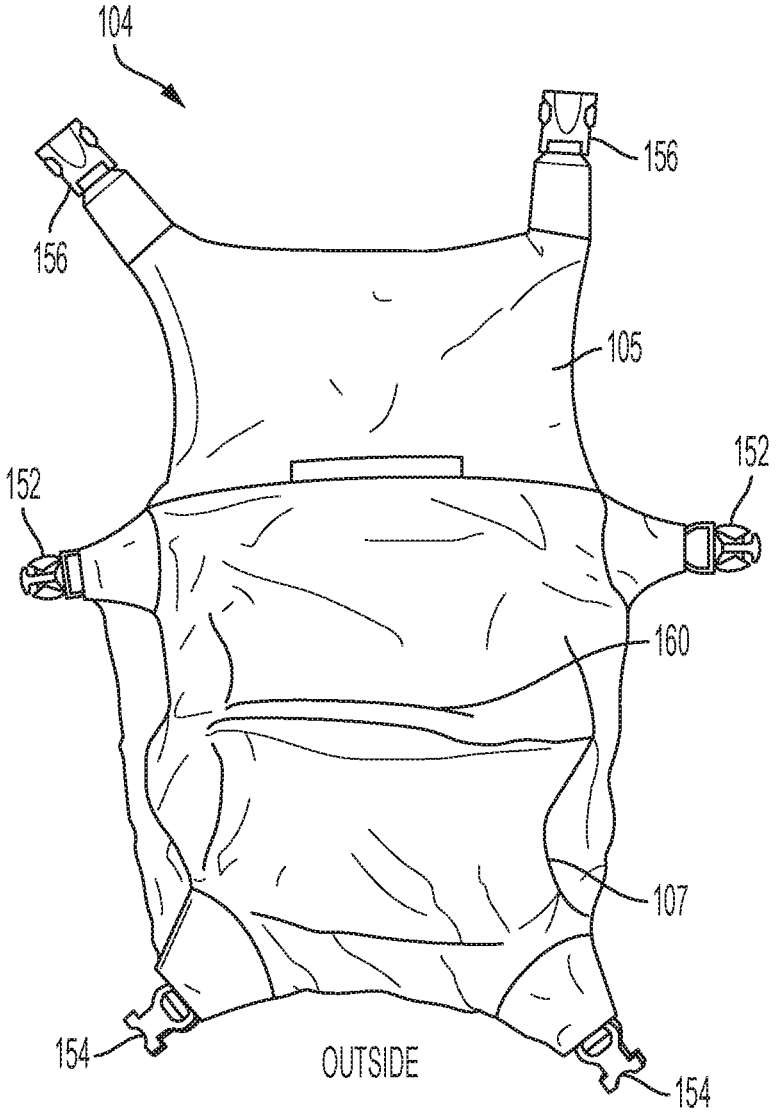
FIG. 11 is a rear view of a child support with upper body support, according to various embodiments described herein.
Figure 12:
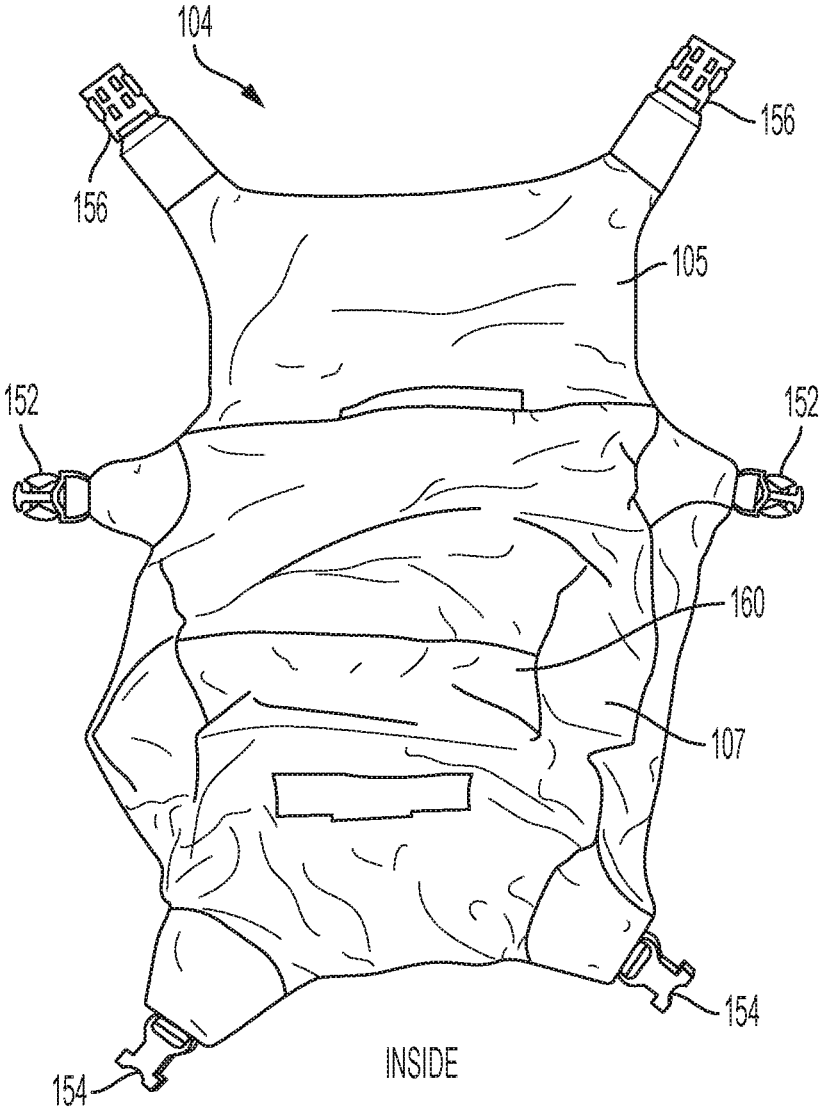
FIG. 12 is a front view of a child support with upper body support, according to various embodiments described herein.

FIGS. 11 and 12 show rear and front views (or outside and inside), respectively, of a child support 104 having an upper body support 105, according to various embodiments. The upper body support 105 may be made from a mesh or any other type of breathable or desired material. One side of the upper body support 105 is attached to the lower body support 107, while the opposite side includes a pair of upper body support releasable attachments 156 that are configured for engagement with the corresponding upper body support releasable attachments 127 of the dual-wrap garment 102. When not in use, the upper body support 105 may be stowed within the upper body support compartment 162 of the child support 104. FIG. 13 shows a close-up view of the upper body support compartment 162 in a closed configuration with upper body support 104 extended and accessible. FIG. 14 shows a close-up view of the upper body support compartment 162 in an open configuration with the upper body support 105 at least partially stowed. After positioning the upper body support 105 and corresponding upper body support releasable attachments 156 fully within the upper body support compartment 162, the compartment may be closed and secured using fasteners 164, which may include Velcro, zippers, buttons, snaps, or any other type of suitable fasteners.

According to an alternative embodiment, the adult or wearer can optionally rotate the dual-wrap garment 102 around approximately 180 degrees to attach the child support 104 on the back of the wearer. To do so, the wearer may position the dual-wrap garment 102 around his or her torso backwards and have another adult attach the child support 104 to the dual-wrap garment 102 on the rear side of the wearer. Alternatively, the dual-wrap garment 102 may be worn as previously described with the child support 104 positioned on the front, then loosen the compression straps 116, rotate the entire child carrying system 100 around the torso 180 degrees, then tighten the compression straps 116 to secure the child in position to the rear of the wearer.

It should be clear from the disclosure above that the dual-wrap child carrying system 100 provides a child carrier that is comfortable to wear and easy to use, distributing the weight of the child through the wearer's core and back in a unique manner that is not prevalent with conventional carriers. The removable child support 104 allows the dual-wrap garment 102 to be worn without the child support 104 when not carrying a child. Because of the compression provided by the secondary wrap 108, coupled with the semi-rigid support of the stays 120, the dual-wrap garment 102 provides postural and back support, and may even be worn to provide the wearer with slimming aesthetic benefits not found with conventional carriers. The compressive nature of the dual-wrap garment 102 may provide post-partum or post-surgical benefits as well. All attachment locations of the child support 104 with respect to the dual-wrap garment 102 are located to the side or in front of the wearer, allowing the wearer to put on and adjust without assistance. The simplicity and removability of the child support 104 allows for any type and styles of child supports 104 to be manufactured and sold separately, to be paired with a single dual-wrap garment 102.

Moreover, according to various embodiments, covers (not shown) may be attached to the child support 104 to provide any desired color, pattern, or other aesthetic or functional feature. For example, the covers may include solid or varied colors, artwork, sports logos, corporate logos, quotes, or any desirable text or visual feature. The covers may be made from mesh or other lightweight, breathable fabric for warm climates, while other covers may be made with insulating material to assist in heat retention or heat management for colder climates. The covers may be attached to the receptacle 160 at or via the child support releasable attachments 150 or any other suitable location. The attachment mechanism may be Velcro, zippers, buttons, snaps, or any other type of suitable fasteners.

According to one embodiment, the upper body support 105 is removably attached to the lower body support 107 of the child support 104. In this manner, upper body supports 105 of varying materials and insulating characteristics may be purchased and interchangeably used according to the current environmental conditions and/or desires of the person wearing the dual-wrap garment 102. Similarly, the child supports 104 themselves are interchangeable such that a single user of a dual-wrap garment 102 may take advantage of any number and type of child supports according to the particular event and/or environmental conditions. A person carrying a child to a sporting event may select a child support 104, an upper body support 105, or a cover having a particular team logo. In this manner, the dual-wrap child carrying system 100 may be used year round in varying weather conditions by utilizing the appropriate child support 104, an upper body support 105, or a cover for the particular time of year or event.

According to alternative embodiments, a child carrying system may include a child carrying garment and a child support 104. The child carrying garment may be any traditional child carrier that is worn by an adult or person for carrying a child. For example, the dual-wrap garment 102 of FIG. 1B may alternatively be a child carrying garment having any type of fastening and support features, with or without a primary wrap and/or secondary wrap described above. The child carrying garment may include or be retrofitted with the releasable attachments 130 for releasably connecting to a child support 104. In this manner, the attached child support 104 may be interchangeable with other child supports 104 according to the particular style of the wearer of the child carrying system, the weather, an event being attended, or any desired reason. The child carrying system may include more than one interchangeable child support 104, with each child support 104 varying in style to accommodate any number and type of situations in which a specific style may be appropriate or desired over another. According to yet another embodiment, the child carrying garment may be a traditional child carrier having a one-piece adult garment with integrated child support. According to this embodiment, interchangeable child supports may be configured to encompass the integrated child support and attached to the adult garment. Doing so allows the interchangeable child support to be visible to provide the primary style of the child carrying system, which may be easily changed by removing the interchangeable child support and replacing it with another having a different style.

Figure 15:
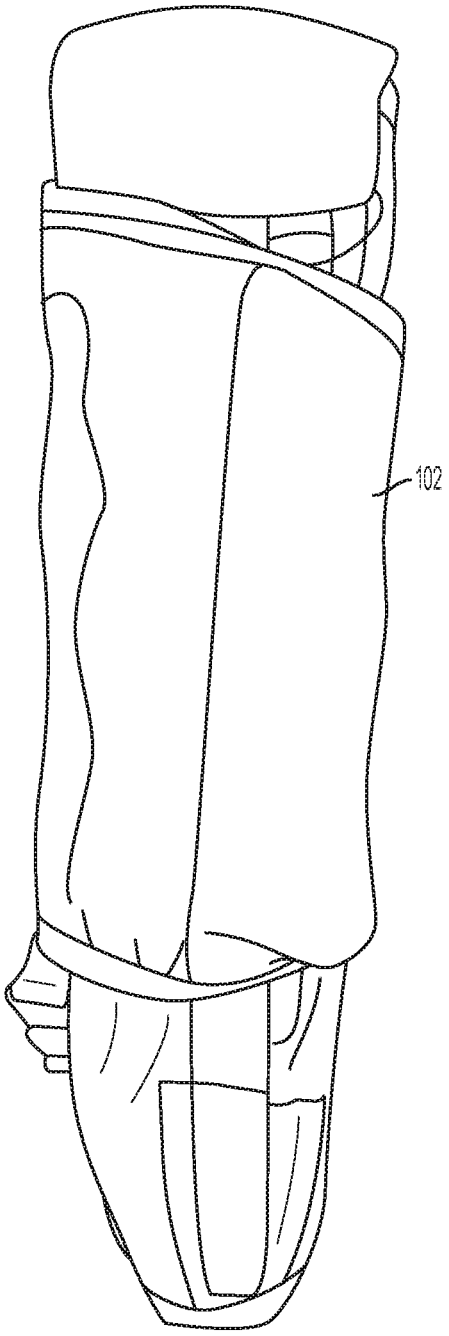
FIG. 15 is a top view of a dual-wrap garment configured in a stowed configuration, according to various embodiments described herein.

Finally, as seen in FIG. 15, the configuration of the dual-wrap garment 102 allows the dual-wrap garment 102 to be rolled up and secured with its own straps to create a small form factor. One or more child supports 104 may be placed inside the dual-wrap garment 102 prior to rolling. This stowed configuration allows the dual-wrap carrying system 100 to be easily packed and/or transported.

CONCLUSION

Many modifications and other embodiments of the disclosure will come to mind to one skilled in the art to which this disclosure pertains having the benefit of the teachings presented in the foregoing descriptions and the associated drawings. For example, as will be understood by one skilled in the relevant field in light of this disclosure, the disclosure may take form in a variety of different mechanical and operational configurations. Therefore, it is to be understood that the disclosure is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed is:

1. A dual-wrap garment configured to be worn by a person for carrying a child, the dual-wrap garment comprising:

a primary wrap having a first end and a second end with a back segment disposed between the first end and the second end, the primary wrap configured to encircle the person such that when the back segment is positioned adjacent to a back side of the person, the first end and the second end wrap around a torso of the person and secure at a front side of the person;

a plurality of stays, each stay extending substantially vertically between a top edge and a bottom edge of the back segment and comprising a semi-rigid material configured to provide flexible support to the back segment;

a secondary wrap configured to encircle the person over the primary wrap and secure at the front side of the person, the secondary wrap comprising:

a first compression strap having a first compression strap fixed end coupled to the primary wrap and an opposite first compression strap adjustment end, and a second compression strap having a second compression strap fixed end coupled to the primary wrap and an opposite second compression strap adjustment end; and a plurality of releasable attachments secured to the primary wrap and configured to engage a plurality of child support releasable attachments coupled to a child support.

2. The dual-wrap garment of claim 1, wherein the first strap fixed end of the first compression strap and the second strap fixed end of the second compression strap are coupled to opposite edges of the back segment of the primary wrap.

3. The dual-wrap garment of claim 1, wherein each of the plurality of releasable attachments comprises a strap having a connection end secured to an edge of the back segment of the primary wrap and a fastener end at an opposite end of the strap configured for coupling to the child support.

4. The dual-wrap garment of claim 3, wherein the strap of each of the plurality of releasable attachments is adjustable in length.

5. The dual-wrap garment of claim 3, wherein the plurality of releasable attachments comprises a pair of upper releasable attachments and a pair of lower releasable attachments.

6. The dual-wrap garment of claim 5, wherein the plurality of releasable attachments further comprises a pair of upper body support releasable attachments.

7. The dual-wrap garment of claim 5, further comprising the child support, the child support comprising:

a fabric receptacle sized and shaped for abutment with a posterior of the child;

the plurality of child support releasable attachments coupled to the fabric receptacle and comprising a pair of upper child support releasable attachments and a pair of lower child support releasable attachments, wherein the child support is configured such that when the plurality of releasable attachments of the primary wrap are engaged with the plurality of child support releasable attachments of the fabric receptacle with the child positioned within the fabric receptacle, the legs of the child are disposed between the pair of upper and the pair of lower child support releasable attachments and the shoulders of the child are positioned above all of the child support releasable attachments.

8. The dual-wrap garment of claim 1, wherein the plurality of stays are arranged substantially parallel to one another within the back segment between the first strap fixed end and the second strap fixed end.

9. The dual-wrap garment of claim 8, wherein the plurality of stays comprises two inner stays having a first length and two outer stays positioned on opposing sides of the inner stays, the two outer stays having a second length that is shorter than the first length.

10. The dual-wrap garment of claim 1, wherein the back segment comprises a plurality of stay pockets, each stay pocket comprising an aperture configured to receive a stay and to allow for removal and replacement of the stay.

11. The dual-wrap garment of claim 1, further comprising one or more shoulder straps secured to the primary wrap via a shoulder yoke.

12. The dual-wrap garment of claim 1, wherein the primary wrap comprises a first material and the secondary wrap comprises a second material having a higher elasticity than the first material.

13. The dual-wrap garment of claim 12, wherein an inside surface of the first end of the primary wrap comprises an engagement material configured to secure the first end to an outside surface of the primary wrap when encircling the person and overlapping an outside surface of the second end, or wherein an inside surface of the second end of the primary wrap comprises the engagement material configured to secure the second end to the outside surface of the primary wrap when encircling the person and overlapping an outside surface of the first end.

14. The dual-wrap garment of claim 13, wherein an inside surface of the first compression strap adjustment end comprises an engagement material configured to secure the first compression strap adjustment end to the outside surface of the primary wrap, and wherein an inside surface of the second compression strap adjustment end comprises an engagement material configured to secure the second compression strap adjustment end to the outside surface of the primary wrap.

15. The dual-wrap garment of claim 1, wherein the child support comprises an interchangeable child support, the dual-wrap garment further comprising:

a plurality of interchangeable child supports, each interchangeable child support comprising a plurality of child support releasable attachments configured for releasable attachment to the plurality of releasable attachments of the primary wrap and comprising a different style than other interchangeable child supports of the plurality of interchangeable child supports.

16. The dual-wrap garment of claim 15, wherein each interchangeable child supports further comprises:

a fabric receptacle sized and shaped for abutment with a posterior of the child, wherein the plurality of child support releasable attachments are coupled to the fabric receptacle and comprise:

a pair of upper child support releasable attachments, and a pair of lower child support releasable attachments.

17. The dual-wrap garment of claim 15, wherein each interchangeable child support further comprises:

an upper body support attached to the fabric receptacle and configured to engage an upper body of the child; and an upper body support compartment within a lower body support portion of the child support, the upper body support compartment configured to stow the upper body support within the lower body support portion when the upper body support is not in use.

18. A dual-wrap child carrying system configured to be worn by a person for carrying a child, the system comprising:

a dual-wrap garment comprising:

a primary wrap configured to encircle the person and secure at a front side of the person;

a plurality of stays, each stay extending substantially vertically between a top edge and a bottom edge of a back segment and comprising a semi-rigid material configured to provide flexible support to the back segment;

a secondary wrap comprising a stretchable textile having a higher elasticity than a material of the primary wrap;

a child support comprising a fabric receptacle and configured to releasably attach to the dual-wrap garment.

19. The dual-wrap child carrying system of claim 18, wherein the child support further comprises:

a plurality of interchangeable child supports, each child support having a different characteristic corresponding to heat management or style.

20. The dual-wrap child carrying system of claim 18, wherein the child support further comprises:

an upper body support attached to the fabric receptacle and configured to engage a head of the child; and an upper body support compartment within a lower body support portion of the child support, the upper body support compartment configured to stow the upper body support within the lower body support portion when the upper body support is not in use.

* * * * *